United States Patent [19]

Ruiz

[11] Patent Number: 4,919,585

[45] Date of Patent: Apr. 24, 1990

[54] VEHICULAR MOUNTED EXCAVATOR

[76] Inventor: Peter L. Ruiz, 2233 Wyandotte Ave., Oroville, Calif. 95966

[21] Appl. No.: 402,753

[22] Filed: Sep. 5, 1989

[51] Int. Cl.[5] ..... B66C 3/00

[52] U.S. Cl. ..... 414/718; 212/268; 414/697

[58] Field of Search ..... 414/685, 687, 688, 694; 212/267, 268, 269, 264

[56] References Cited

U.S. PATENT DOCUMENTS

| | | | |
|---|---|---|---|
| 2,411,498 | 11/1946 | Billings . | |
| 2,784,855 | 3/1957 | Acker . | |
| 2,927,706 | 3/1960 | Mork . | |
| 3,351,221 | 11/1967 | Smalley . | |
| 4,257,731 | 3/1981 | Beaver . | |
| 4,759,685 | 7/1988 | Souda | 414/718 X |
| 4,793,765 | 12/1988 | Paul et al. | 414/718 |

*Primary Examiner*—David A. Bucci
*Assistant Examiner*—Donald W. Underwood

[57] ABSTRACT

A rotatable, vertically positioned boom support attached to a flat-bed truck. The boom support is rotatable through the use of meshed gearing powered by a reversible hydraulic motor. The boom support pivotally retains a hydraulically repositionable boom. The boom is affixed to, and supports a vertically positionable digging arm with a telescopically attached hydraulically powered digging bucket. The digging arm is structured with two slidable sections allowing the digging arm with attached digging bucket to be extended for greater reach. The slidable sections of the digging arm are repositionable through the use of hydraulic rams. One hydraulic ram is used to raise and lower the digging arm relative to the boom. The other hydraulic ram is used to raise and lower the telescopically attached digging bucket. An operator's seat and hydraulic control levers are positioned adjacent the boom support. The digging arm may be positioned vertically for digging vertical shafts, at an angle for digging trenches, or horizontal above the boom for transporting.

7 Claims, 9 Drawing Sheets

VEHICULAR MOUNTED EXCAVATOR

BACKGROUND OF THE INVENTION

1. Field of the Invention

This invention is associated with earth-working equipment such as back hoes, pull shovels, dippers and the like, useful for digging holes and trenches in the earth. The invention is particularly directed towards a hydraulically powered excavating structure adapted for mounting on a flat-bed truck or similar vehicle. The excavator is primarily adapted for digging vertical shafts with straight sidewalls, but may also be used for digging trenches.

2. Description of the Prior Art

A past art search was conducted at the U.S. Patent Office on the above referenced subject in the following U.S. classes and subclasses: 414/694, 695.5

The following patents are noted as being most pertinent to my invention:

1. U.S. Pat. No. 4,257,731 teaches a back hoe type machine. This particular excavator has a boom attached adjacent the digging implement extending from the digging implement at an angle. The angle of the boom would cause the boom to hit the top edge of a vertical shaft limiting the possible depth of the shaft.

2. U.S. Pat. No. 3,351,221 teaches a towable back hoe device which might be used for digging a shallow vertical shaft, however it is primarily designed for excavating graves.

3. U.S. Pat. No. 2,927,706 teaches a hydraulically-operated dipper having a rotatably affixed dipper or bucket.

4. U.S. Pat. No. 2,784,855 teaches a boom mechanism for digging machines. The boom is generally horizontal tubular telescoping arrangement using a hydraulic ram to raise and lower a generally vertical bucket arm. The raising and lowering of the bucket arm with attached bucket changes the angle of the telescoping boom.

5. U.S. Pat. No. 2,411,498 teaches a pull shovel having a telescoping bucket support structure. The pull shovel is operated using a combination of hydraulic rams, cables and pulleys. This digging device appears well suited for trenching but would not work well for vertical shaft digging due to the angled position of one pull cable which would hit the upper top edge of a vertical shaft.

Of the above examined patents, none were considered to be physically structured similar to mine and none appeared to be as well suited for both deep vertical shaft digging and horizontal trenching.

SUMMARY OF THE INVENTION

In practicing my invention I have structured a hydraulically powered excavator with a rotatably attached vertically oriented boom support mounted to a flat-bed truck. Attached to the upper end of the boom support is a pivotally mounted boom adapted to be raised and lowered by a hydraulic ram. Attached to the distal end of the boom opposite the boom support, is a digging arm structured of two stages of slidable sections. Attached to the lower end of one telescoping slidable section of the digging arm is a pivotally attached digging bucket repositionable by way of a hydraulic ram attached to the telescoping slidable section. The second slidable section is attached to the boom and is adapted to allow raising and lowing the digging arm relative to the boom. The slidable sections of the digging arm are repositionable through the use of hydraulic rams with one ram for extending each stage or slidable section of the digging arm.

The excavator is particularly structured for digging straight downward, having the boom slidably attached to the digging arm to allow the boom to be positioned at the upper most end of the digging arm during maximum extension or reach. The structure allowing placement of the boom at the upper most end of the digging arm greatly reduces the possibility of the boom from striking the upper top edge of a vertical shaft as happens with past art excavators.

With my excavator being capable of digging narrow vertical shafts having straight sidewalls, my excavator is more versatile than past art machines, allowing for digging straight vertical holes in the earth for such matters as footings for buildings and bridges, shallow water wells, soil sampling test holes and the like. Although some of the past art excavators are capable of digging deep holes in the earth, most or all of the past art machines which are structured remotely similar to mine would have to dig elongated deep holes which would not be suitable for deep bridge and building footings since these footings are always filled with concrete and it would take many times the amount of concrete to fill the trench-like holes. Rotary core drilling equipment which is often used for such deep vertical shaft footings are not considered similar to my invention and are not capable of digging trenches as my excavator.

My excavator also being well suited for horizontal trenching makes it useful for ditching for laying piping, irrigation ditches and canals, or shallow horizontal building footings and the like.

Therefore it is a primary object of the invention to provide an excavator structured for digging vertical shafts having straight sidewalls with the boom supporting the digging arm placeable at the upper end of the digging arm to allow unobstructed shaft digging.

A further object of my invention is to provide an excavator capable of digging both vertical shafts and horizontal trenches.

An even further object of my invention is to provide an excavator which is capable of being easily transported on a vehicle once mounted.

A still further object of my invention is to provide an excavator using telescoping and sliding members to allow the digging arm to be extended in length.

Other objects and the many advantages of my invention will become clear with a further reading of the specification and a comparison of the numbered parts with like numbered parts shown in the accompanying drawings.

DESCRIPTION OF THE PREFERRED EMBODIMENT

Figure 1:
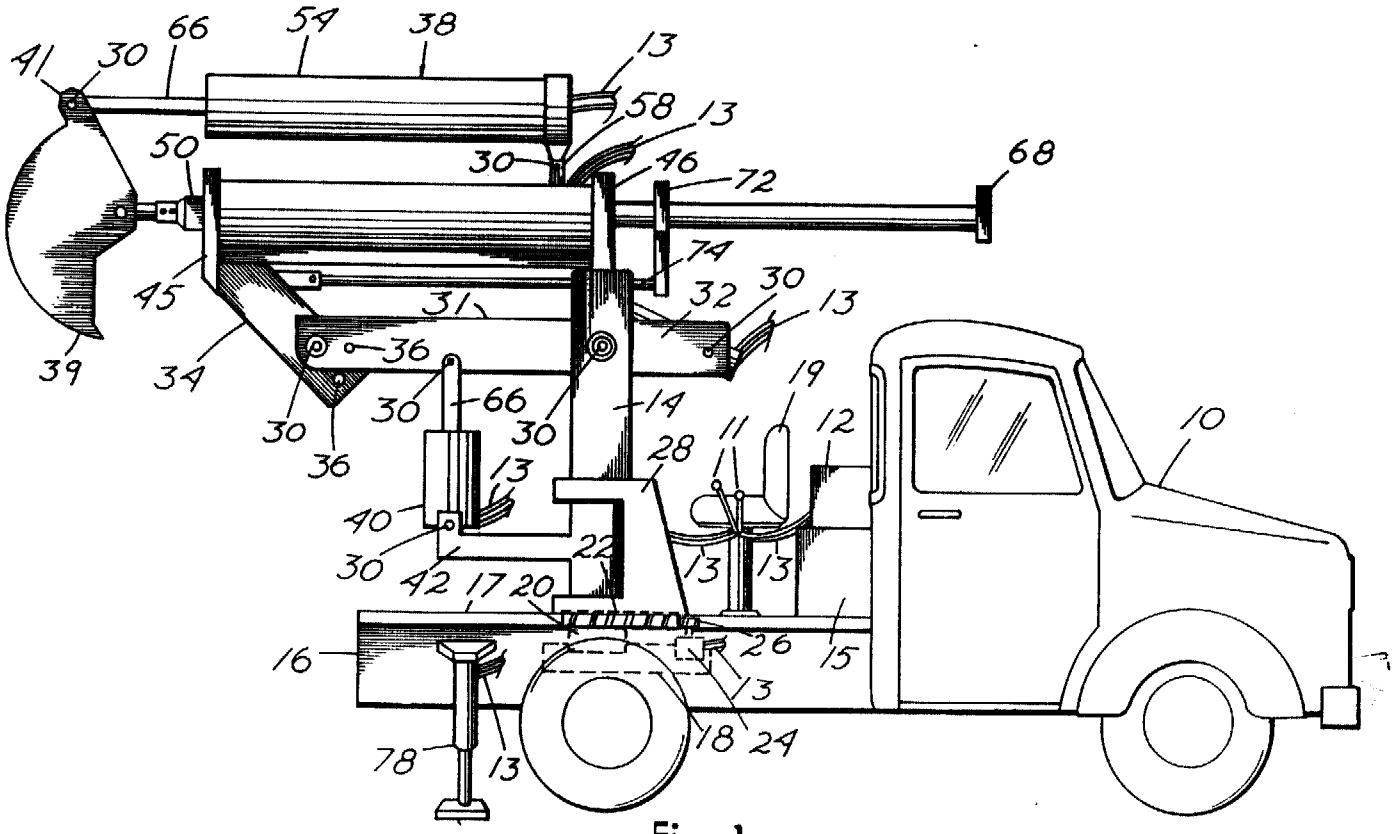
FIG. 1 shows the excavator mounted on a flat-bed truck. The excavator is shown in position to allow the truck to be driven to the job site.

Referring now particularly to the side view in FIG. 1 and to the drawings in general where a flat-bed truck 10 is shown equipped with my excavator and the necessary support equipment to operate the excavator. Shown directly behind the cab of truck 10 is a gasoline or diesel powered engine compartment 15 with attached hydraulic pump and fluid reservoir designated hydraulic fluid pumping station 12. The pumping station 12 is attached by way of flexible hydraulic fluid lines 13 to hydraulic fluid control valves with control levers 11 adjacent operator's seat 19. Control valves with levers 11 are adapted to allow the operator to control all the various hydraulically powered devices of the excavator with power supplied from hydraulic pumping station 12 while sitting on seat 19. The hydraulic fluid pumping station 12 in this particular case is exclusively for operating the hydraulic components of the excavator. The flat-bed truck has a separate gas or diesel powered engine under the hood allowing it to be driven. The retractable hydraulic truck stabilizing arms 78 used to stabilize and take pressure off the axle springs of truck 10 are also controllable from seat 19. See FIG. 1 and 9.

Figure 9:
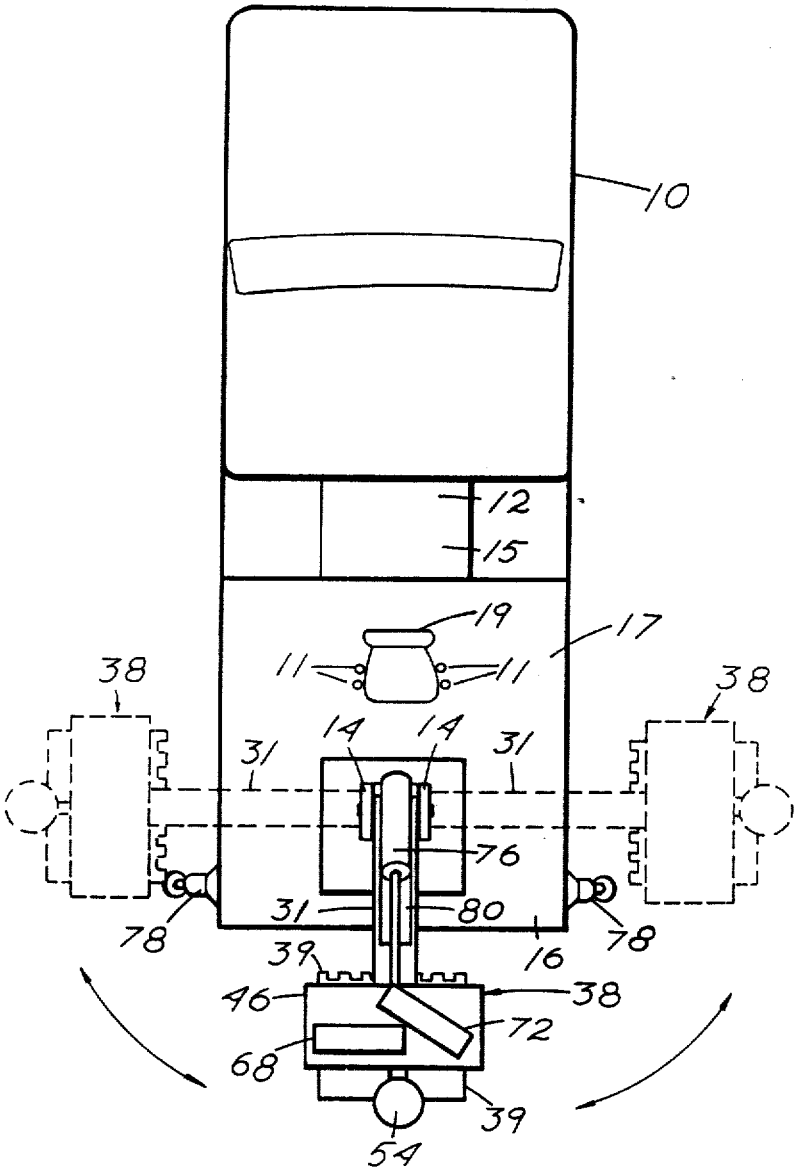
FIG. 9 illustrates from a top view of the flat-bed truck with attached excavator the ability of the excavator to rotate to each side of the truck to discard dirt or to dig.

An elongated boom support 14 attaches generally centrally to truck bed 17 toward rear end 16 of truck 10 and extends vertically upward from truck 10 to serve as the support for boom 31. The lower end or base 20 of boom support 14 is rotatably attached to truck 10 by way of a bearing cage 18 securely attached to the truck framework below the bed 17 of truck 10. Above bearing cage 18 affixed around boom support 14 is a gear 22 positioned to mesh with gear 26 attached to reversible hydraulic motor 24. Activation of motor 24 causes boom support 14 with attached boom 31 to rotate to either side of truck 10 as illustrated in FIG. 9. A gear cover 28 would normally be used to cover gears 22 and 26 for safety purposes.

Figure 2:
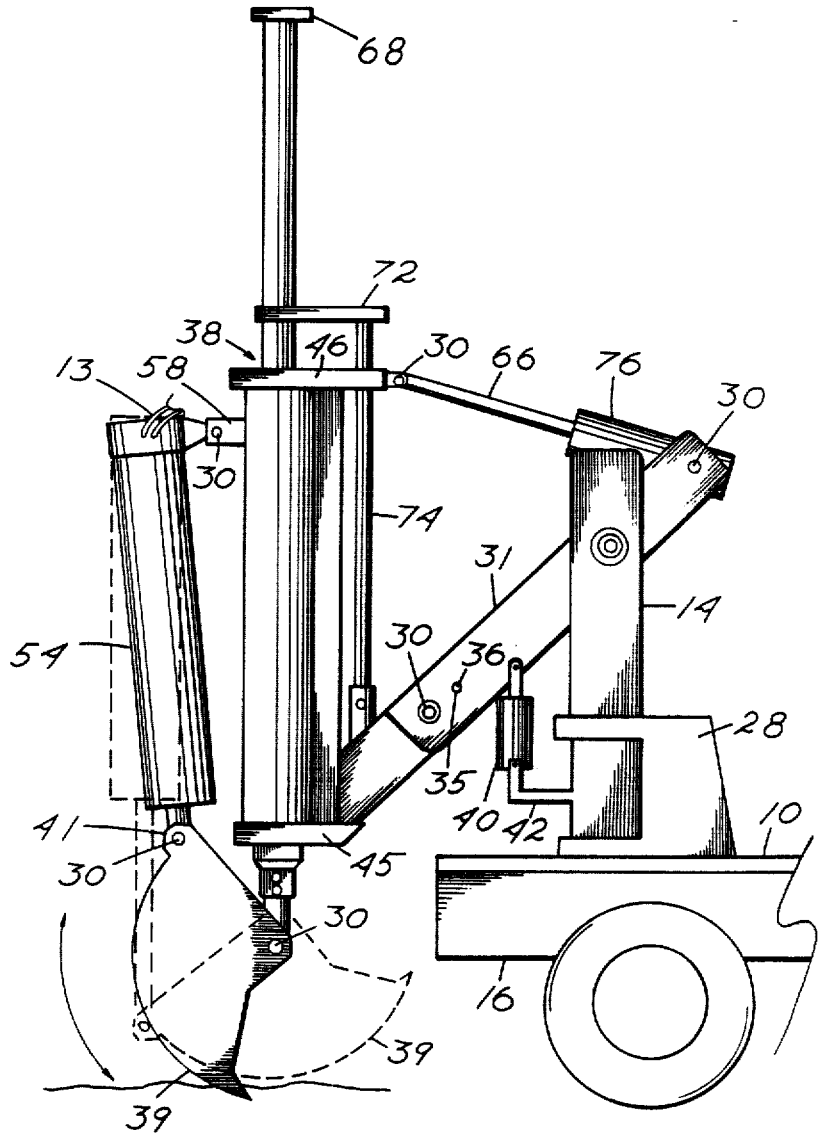
FIG. 2 illustrates the back end of the truck with the digging arm of the excavator in a generally vertical position beginning to dig a vertical shaft. The pivotal scooping movement of the digging bucket is illustrated using dotted lines.

Pivotally attached toward the upper end of boom support 14 at a pivotal attachment 30 is the first end of boom 31. Boom 31 is structured of two sections. The first section, boom section 32 being the section attached to boom support 14, and the second boom section 34 attached by a pivotal attachment 30 to the distal end of boom section 32 of boom 31 shown in FIG. 1 above back end 16 of the truck. Boom section 34 is adapted to be locked in a straight alignment with boom section 32 as shown in FIG. 2 by way of a removable steel pin 35 inserted through aligned apertures 36 through boom sections 32 and 34. The pin 35 removed as shown in FIG. 1 allows boom section 34 to pivot upward allowing a horizontal positioning of the digging arm for transporting. The pin 35 may also be removed during digging in order to alter the angle between boom 31 and the attached digging arm 38.

Attached adjacent the base or lower end of boom support 14 by a pivotal attachment 30 is one end of a boom lifting hydraulic ram 40. The opposite end of hydraulic ram 40 is pivotally attached to one end of arm 42. The opposite end of arm 42 is rigidly attached to the rotatable boom support 14. Hydraulic ram 40 is adapted to raise and lower a first end of boom 31 relative to a second end of the boom 31, or raise and lower the attached digging arm 38 by way of raising boom 31.

Figure 6:
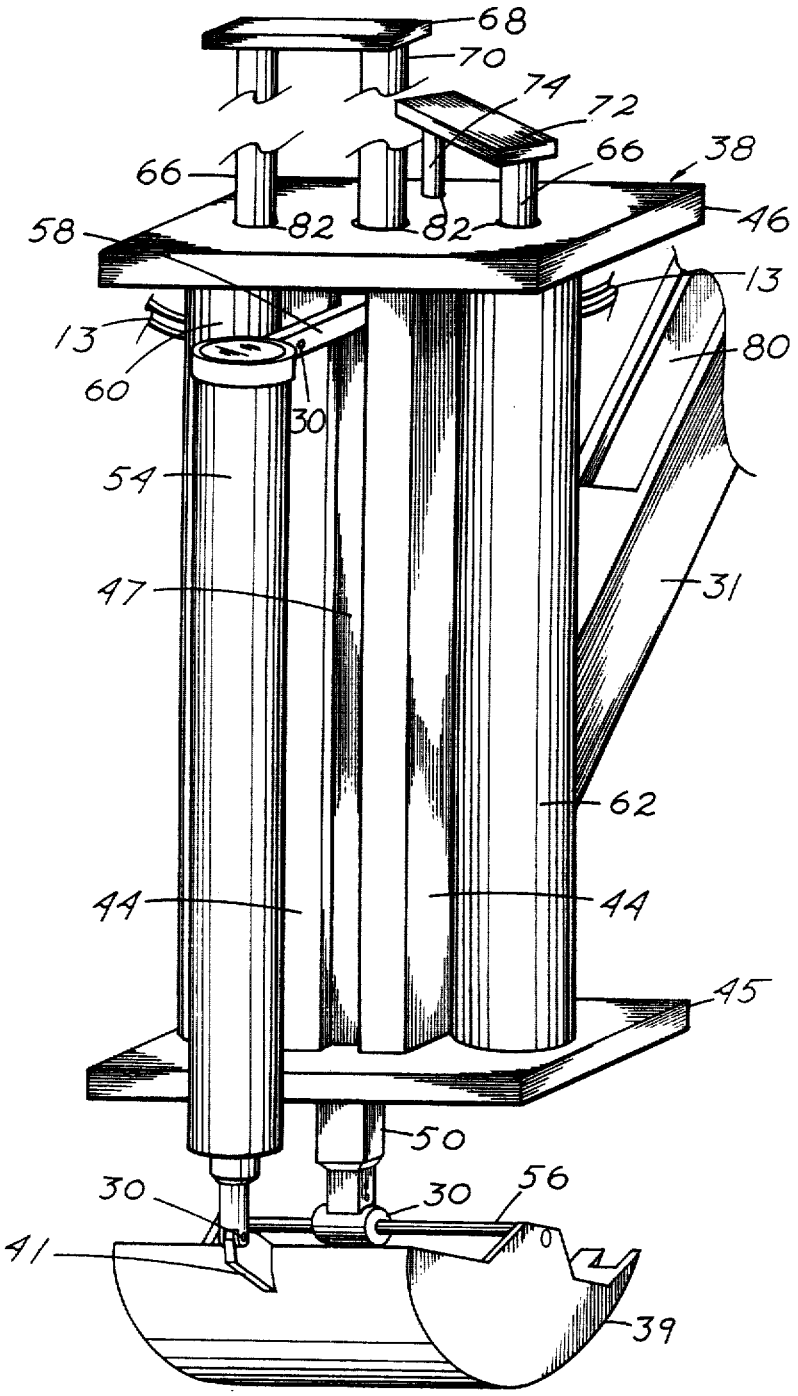
FIG. 6 is a rear perspective view of the digging arm showing the hydraulic ram which powers the pivotal movement of the digging bucket, and the two hydraulic rams which power the two stages of slidable sections of the digging arm. Also shown are connecting rods extending from the upper end of the digging arm. The slidable sections are connected to the hydraulic rams by way of the connecting rods.
Figure 7:
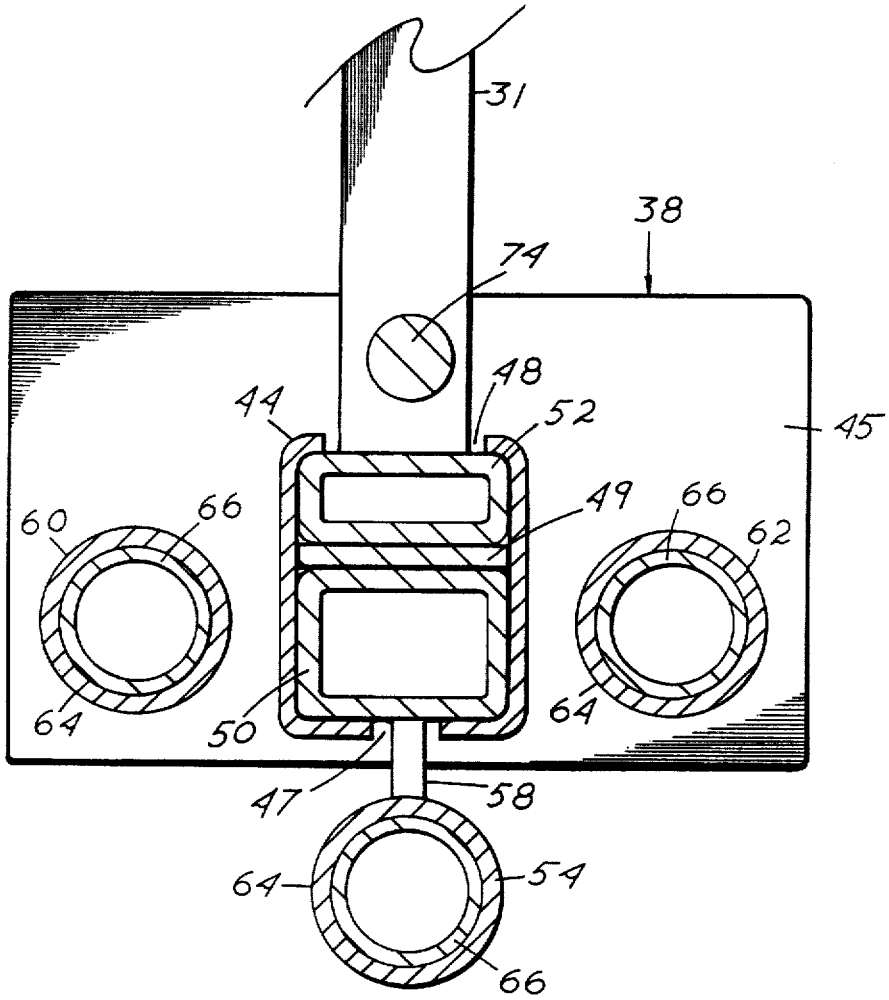
FIG. 7 is a cross-sectional view of the digging arm as it would appear looking downward toward the ground. Shown is a large rectangular bottom plate of the digging arm, and a main tubular housing having two slidable members therein separated by a center dividing wall. Three hydraulic rams are shown adjacent the tubular housing, and the boom is shown attached to one of the slidable members by way of passing through one of two slots in the tubular housing.

Attached to the distal end or second section 34 of boom 31 is the digging arm 38. Digging arm 38 is shown in all drawing figures, but is particularly detailed in FIG. 6 through 8. Digging arm 38 is structure of an elongated main tubular housing 44 affixed lengthwise between two rectangular steel plates designated top plate 46 being at the top or upper end of the digging arm 38, and bottom plate 45 being at the bottom or lower end of the digging arm 38 as shown in FIG. 6. Main tubular housing 44 in partitioned lengthwise by wall 49 shown in FIG. 7 to form two separate compartments. There are two elongated slots extending the length of main tubular housing 44. The first slot 47 shown in FIG. 6 and 7 is oppositely disposed from the second slot 48 shown in FIG. 7. The first slot 47 is in communication with one compartment, and the second slot 48 is in communication with the second compartment of the main tubular housing 44.

Figure 8:
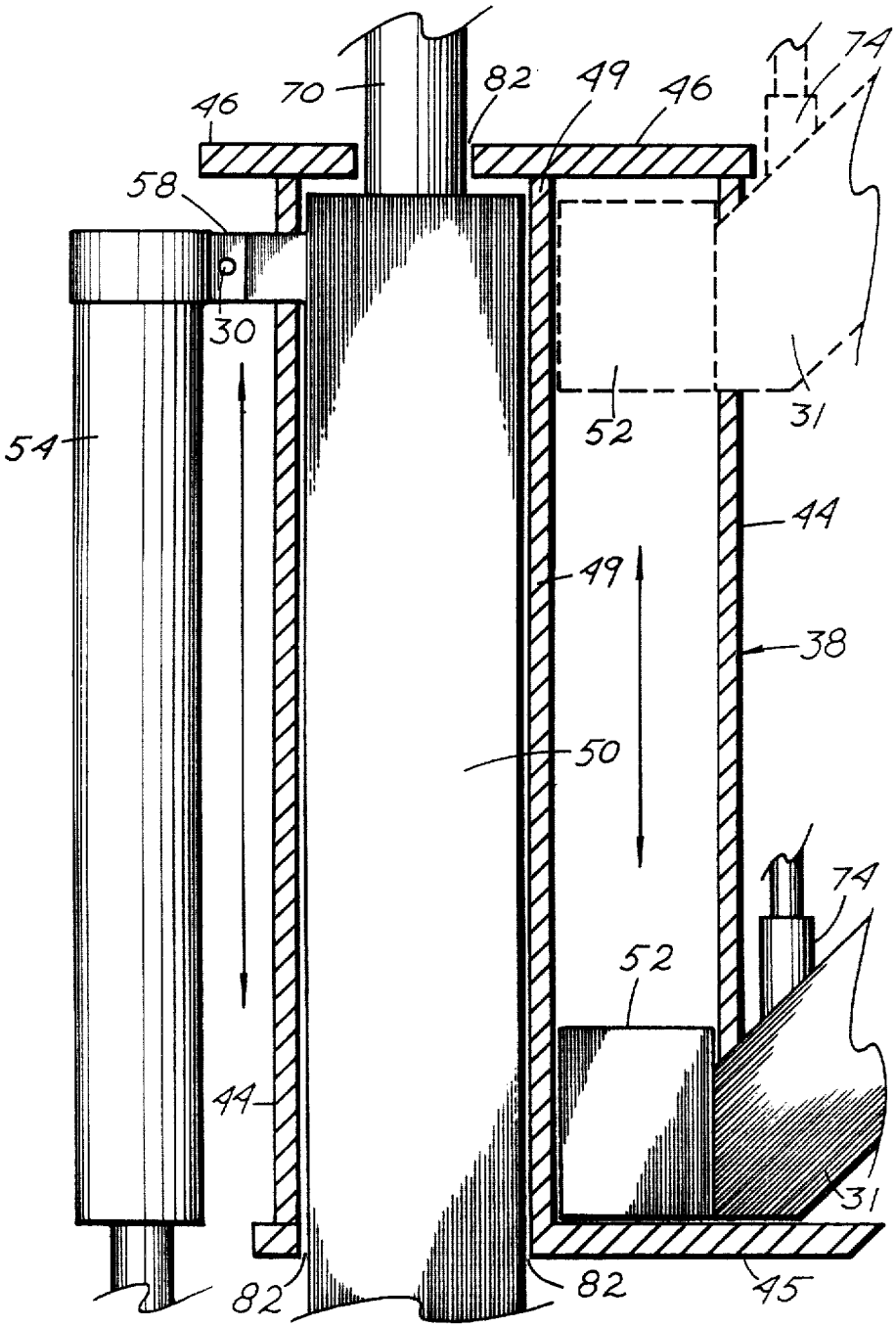
FIG. 8 is an illustrative sectional side view of the main body of the digging arm showing the dividing wall and two slidable members.

Retained within main tubular housing 44 are two slidable members, one on each side of wall 49. The first slidable member 50 is an elongated tubular piece of steel longer than the length of main tubular housing 44. The lower or bottom end of first slidable member 50 extends through an aperture 82 in bottom plate 45 as shown in FIG. 8. As shown in FIG. 6, the lower end of slidable member 50 attaches using a pivotal attachment 30 centrally to the center support rod 56 of the digging bucket 39. Digging bucket 39 is a well known scoop-like digging structure having claws at the front end for ripping the ground into pieces to allow the pivotal bucket 39 to pick the dirt up during excavation. Pivotally attached to the rearward end 41 of bucket 39 is the first end of a bucket repositioning hydraulic ram 54. The second end of hydraulic ram 54 is attached to one end of a short connecting rod 58 by a pivotal attachment 30. Connecting rod 58 then extends through first slot 47 where it is rigidly affixed to the top or upper side edge of first slidable member 50.

Opposite first slot 47 is second slot 48. The end of boom section 34 of boom 31 extends through second slot 48 to attach to second slidable member 52. Second slidable member 52 is a short tubular member position inside main housing 44 as shown in FIG. 8. Both slidable members 50 and 52 are sized and shaped cooperatively to be able to slide in their respective compartmentalized area of main tubular housing 44. Heavy grease is used between the slidable members and the interior sidewalls of the main tubular housing 44.

Shown in FIG. 6 and 7 are two hydraulic rams, 60 and 62, one on each side of main tubular housing 44 designated first slidable member repositioning hydraulic ram 60 and second slidable member repositioning hydraulic ram 62. The outer casings or housings 64 of each ram 60 and 62 is retained between top plate 46 and bottom plate 45. The inner sliding cylinder 66 of each ram 60 and 62 extends upward through separate apertures 82 in top plate 46 as shown in FIG. 6. Attached to the upper end of first slidable member 50 as shown in FIG. 8 is first slidable member connecting rod 70 which also extends through a separate aperture 82 in top plate 46. The upper end of sliding cylinder 66 of first slidable member repositioning hydraulic ram 60 and connecting rod 70 are attached together above top plate 46 with a rigid steel plate, first tie bar 68.

The upper end of sliding cylinder 66 of second slidable member repositioning hydraulic ram 62 is attached to a first end of second tie bar 72. Attached to the second end of second tie bar 72 is attached to second slidable member connecting rod 74. Connecting rod 74 from where it attaches to tie bar 72 extends downward through a separate aperture 82 in top plate 46 extending parallel to the outside edge of main tubular housing 44 to where the rod 74 attaches to boom 31.

Figure 4:
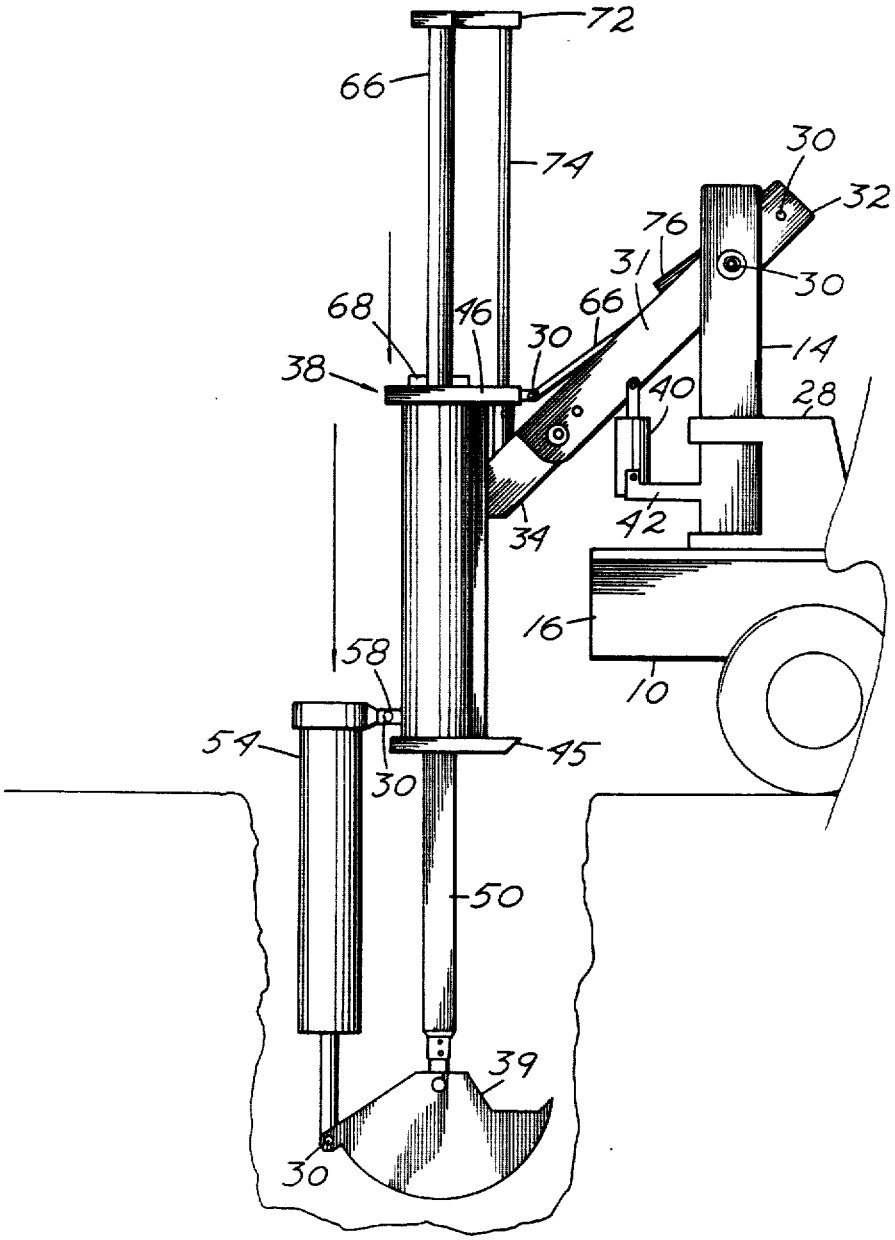
FIG. 4 illustrates the back end of the truck with the digging arm of the excavator in a generally vertical position and both the first and second stages of the digging arm extended for maximum depth in digging a vertical shaft. The boom is positioned at the top of the digging arm and is shown well above the top edges of the generally straight sidewalls of the vertical shaft. Repositioning of the digging arm relative to the boom is considered the second stage of extendability of the digging arm.

As shown in FIG. 2, digging arm tilting hydraulic ram 76 is pivotally attached at a first end thereof by a pivotal attachment 30 to the first end of boom 31. The second end of digging arm tilting hydraulic ram 76 is pivotally attached to top plate 46 by a pivotal attachment 30. With pin 35 removed from apertures 36 of boom 31, the angle of digging arm 38 may be altered relative to both boom 31 and the ground line by way of extending or retracting digging arm tilting hydraulic ram 76. Shown in FIG. 6 and 9 is a slot 80 in the top of boom 31 adjacent digging arm 38. Slot 80 is necessary for clearance between ram 76 and boom 31 under certain positions of the boom 31 relative to digging arm 38 as shown in FIG. 4.

Referring now to FIG. 6 and 7, and to FIG. 8 where a sectional side view of digging arm 38 is shown to illustrate the sliding mechanics of digging arm 38. FIG. 8 shows both first and second slidable members 50 and 52 in solid lines to illustrate the position of the slidable members 50 and 52 when the digging arm 38 is in the fully retracted position. The upper or top end of first slidable member 50 is shown positioned adjacent top plate 46. This positioning puts digging bucket 39 as close as is possible to bottom plate 45 as shown in FIG. 1 and 2. To reposition first slidable member 50 with attached digging bucket 39 downward, the sliding cylinder 66 of first slidable member hydraulic ram 60 is extended. Extending the sliding cylinder 66 of first slidable member hydraulic ram 60 pulls first slidable member 50 upward in main tubular housing 44 by way of connecting rod 70 and first tie bar 68. Retracting the sliding cylinder 66 of first slidable member hydraulic ram 60 pushes first slidable member downward in housing 44 by way of connecting rod 70 and first tie bar 68. This is the first stage of extendability of the digging bucket 39.

The second stage of extendability is accomplished by way of repositioning digging arm 38 relative to attached boom 31. In FIG. 8 second slidable member 52 is shown in solid line in the bottom or lower end of main tubular housing 44 positioning the digging arm 38 upward relative to boom 31. To position second slidable member 52 with attached boom 31 to the top or end upper of main tubular housing 44 as shown in FIG. 8 in dotted lines, second slidable member repositioning hydraulic ram 62 is extended to push digging arm 38 downward relative to boom 31 by way of connecting rod 74 and second tie bar 72. Second slidable member repositioning hydraulic ram 62 is retracted to position digging arm 38 upward relative to second slidable member 52 and boom 31.

For maximum extension of digging bucket 39, first slidable member 50 is fully extended, second slidable member 52 with attached boom 31 is positioned to the top end of main tubular housing 44, and the digging arm 38 supporting end of boom 31 is lowered toward the ground.

Figure 3:
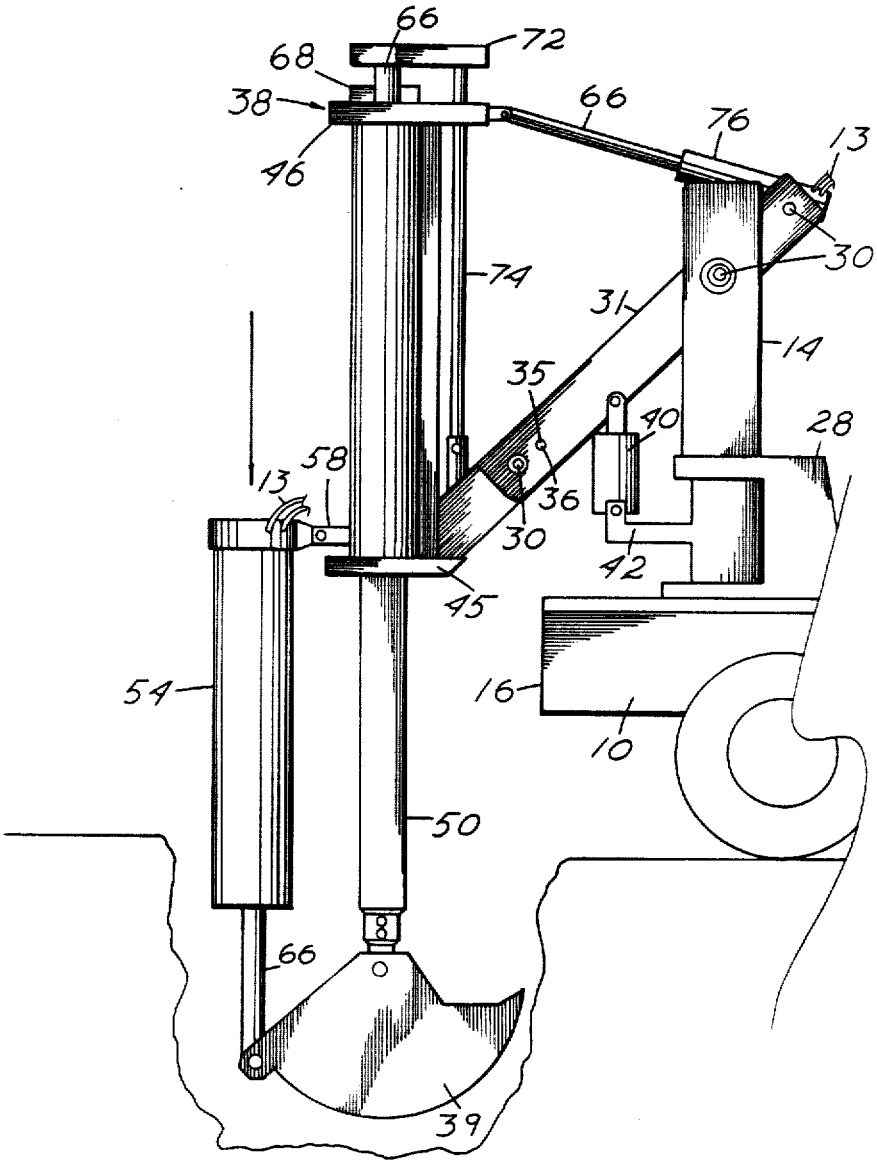
FIG. 3 illustrates the back end of the truck with the digging arm of the excavator in a generally vertical position and the first stage or bucket supporting telescoping member of the digging arm extended.

FIG. 2 demonstrates the position of digging bucket 39 when beginning to dig a straight vertical shaft. The claw or front of the bucket 39 is forced into the ground while at the same time the bucket is pivoted forward to scoop up dirt. The bucket 39 is then retracted to clear the top side edge of the shaft and the boom 31 with swung to the side of truck 10 to dump the dirt as shown in FIG. 9. FIG. 3 illustrates the maximum digging depth using stage one or first slidable member 50 extended. FIG. 4 illustrates the maximum digging depth using both stage one and stage two fully extended. Note that boom 31 is positioned at the top end of digging arm 38.

Figure 5:
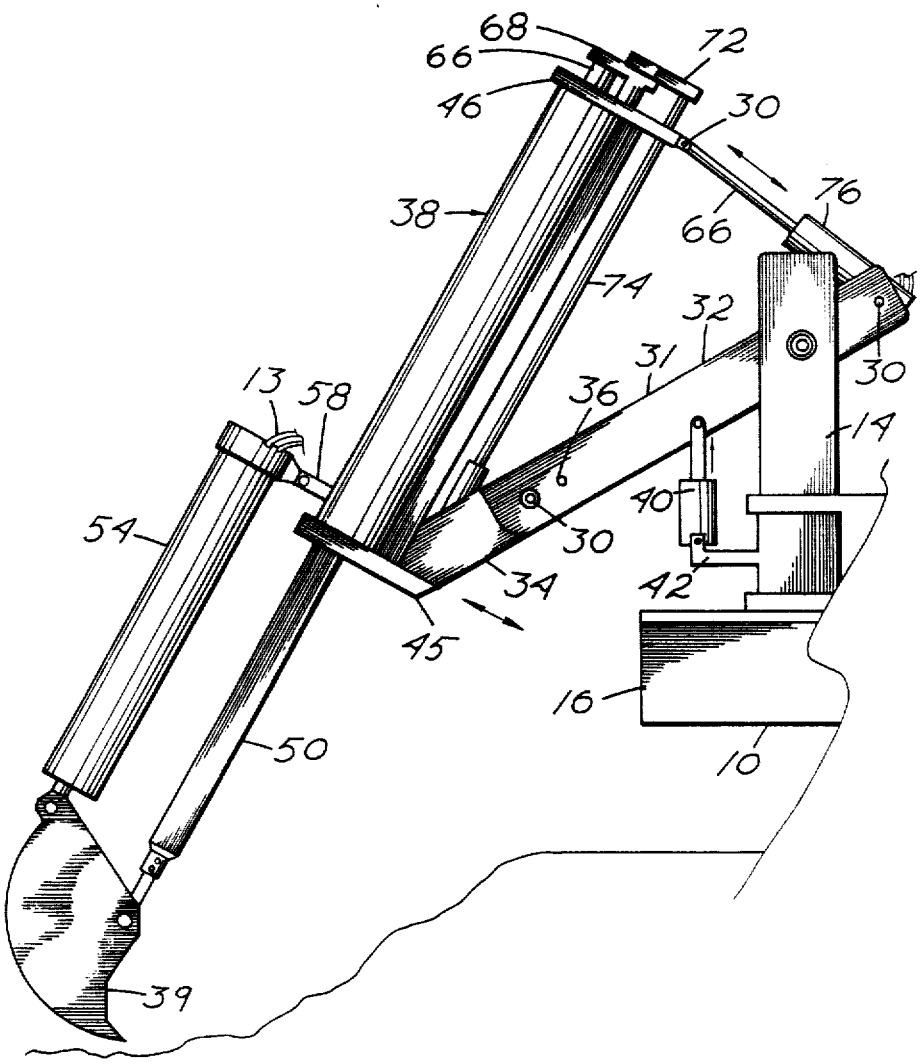
FIG. 5 illustrates the back end of the truck with the digging arm of the excavator in an angled position with the first stage or bucket supporting telescoping member extended for digging a trench. The angle of the digging arm is positionable at various angles, and the second stage may be extended by repositioning the boom toward the top of the digging arm for even greater reach.

FIG. 5 illustrates the use of my excavator in an angled position digging a trench. The removable pin 35 has been removed from apertures 36 to allow changing of the angle between boom 31 and digging arm 38 by way of tilting hydraulic ram 76. Raising and lower boom 31 also changes the angle of digging arm 38 relative to the ground.

The above disclosure coupled with the drawings should be more than adequate to allow those skilled in the art to build and operate my excavator. Also, because I have described my invention and shown it by way of drawings in considerable detail, it will be obvious to those skilled in the art that modifications in the structure shown and described are possible without departing from the scope of the appended claims.

I claim:

1. A vehicular mounted excavator adapted for both horizontal trenching and vertical shaft digging, comprising;

an elongated boom support attached to said vehicle, said boom support adapted to be rotated by hydraulically powered means, said boom support further adapted to be used in a generally vertical position;

a boom having a first and second end, said boom pivotally attached at said first end to an upper end of said boom support;

hydraulically powered means adapted for raising and lowering said second end of said boom relative to said first end of said boom;

a digging arm structured of an elongated main tubular housing, a first longitudinal slot through said main tubular housing, a second longitudinal slot through said main tubular housing and oppositely disposed from said first slot, a first and second slidable member each slidably housed within said main tubular housing, said boom at said second end thereof extending through said second slot and attaching to said second slidable member, a pivot point in said second end of said boom adjacent said second slidable member, means for locking said pivot point temporarily rigid, a digging arm tilting hydraulic ram attached at a first end thereof to said first end of said boom, said digging arm tilting hydraulic ram attached at a second end thereof to said digging arm, said digging arm tilting hydraulic ram adapted to allow altering angles between said boom and said digging arm, one end of said first slidable member extending beyond a bottom end of said main tubular housing pivotally attaching generally centrally to a digging bucket member adapted to scoop earth, a bucket repositioning hydraulic ram having a first and second end with said first end pivotally attached to a rearward end of said digging bucket member, said second end of said bucket repositioning hydraulic ram attached by pivotal attachment means to one end of a connecting arm, an opposite end of said connecting arm extending through said first slot in said main tubular housing and attaching to said first slidable member, said bucket repositioning hydraulic ram adapted to cause pivoting of said digging bucket member, a first slidable member repositioning hydraulic ram attached to said first slidable member adapted to raise and lower said first slidable member relative to said main tubular housing, a second slidable member repositioning hydraulic ram adapted to raise and lower said main tubular housing relative to said second slidable member with attached boom relative;

powering means for said hydraulic rams and said hydraulically powered means of said boom and said boom support;

controls adapted to be manually activated to actuate said hydraulic rams and said hydraulically powered means of said boom and said boom support;

said digging arm adapted for vertical positioning providing for digging generally straight side walled vertical shafts, said boom attached to said second slidable member of said digging arm adapted for placement at an upper end of said digging arm when said digging arm is in said vertical position allowing digging said vertical shafts to a maximum depth;

said digging arm adapted for angled positioning providing for digging said horizontal trenches.

2. The vehicular mounted excavator as described in claim 1 with said boom support adapted to be rotated by hydraulically powered means wherein said hydraulically powered means is a reversible hydraulic motor linked by gearing to said boom support.

3. The vehicular mounted excavator as described in claim 1 with said hydraulically powered means adapted for raising and lowering said second end of said boom relative to said first end herein said hydraulically powered means is a hydraulic ram attached at a first end thereof to said boom and attached by attachment means at a second end thereof to said rotatable boom support.

4. The vehicular mounted excavator as described in claim 1 with powering means for said hydraulic rams and said hydraulically powered means of said boom and said boom support wherein said powering means is a gasoline engine adapted to power a hydraulic pump, there being hydraulic fluid lines extending from said hydraulic pump to said controls adapted for manual activation, there further being hydraulic lines extending from said controls to said hydraulic rams and said hydraulically powered means of said boom and said boom support.

5. The vehicular mounted excavator as described in claim 1 with powering means for said hydraulic rams and said hydraulically powered means of said boom and said boom support wherein said powering means is a diesel engine adapted to power a hydraulic pump, there being hydraulic fluid lines extending from said hydraulic pump to said controls adapted for manual activation, there further being hydraulic lines extending from said controls to said hydraulic rams and said hydraulically powered means of said boom and said boom support.

6. The vehicular mounted excavator as described in claim 1 with said controls adapted to be manually activated to actuate said hydraulic rams and said hydraulically powered means of said boom and said boom support wherein said controls are lever actuated hydraulic valves positioned by an operator's seat.

7. The vehicular mounted excavator as described in claim 1 wherein said vehicle is a flat-bed truck.

* * * * *